United States Patent [19]

Gebhard

[11] Patent Number: 4,492,263

[45] Date of Patent: Jan. 8, 1985

[54] INFANT SECURITY DOOR GATE ASSEMBLY

[75] Inventor: Albert W. Gebhard, Denver, Colo.

[73] Assignee: Gerico, Inc., Denver, Colo.

[21] Appl. No.: 527,777

[22] Filed: Aug. 30, 1983

Related U.S. Application Data

[63] Continuation of Ser. No. 283,044, Jul. 13, 1981, abandoned.

[51] Int. Cl.[3] ..... E06B 3/12

[52] U.S. Cl. ..... 160/228; 160/222

[58] Field of Search ..... 160/215, 216, 222–228; 49/55, 57, 163; 211/105.3–105.6

[56] References Cited

U.S. PATENT DOCUMENTS

| | | | |
|---|---|---|---|
| Re. 19,617 | 6/1935 | Van Dresser | 20/71 |
| 520,584 | 5/1894 | Turner et al. . | |
| 565,546 | 8/1896 | Kingston . | |
| 625,926 | 5/1899 | Graham . | |
| 777,322 | 12/1904 | Wright . | |
| 1,213,213 | 1/1917 | Knaack et al. | 160/228 |
| 1,242,413 | 10/1917 | Archard | 160/228 |
| 1,662,167 | 3/1928 | Rexinger . | |
| 1,679,881 | 8/1928 | Simpson . | |
| 2,079,267 | 5/1937 | Vroom et al. | 156/19 |
| 2,594,864 | 4/1952 | Buckland et al. | 160/351 |
| 2,701,927 | 2/1955 | Dyer | 39/87 |
| 2,756,469 | 7/1956 | Cattermole et al. | 20/71 |
| 2,814,340 | 11/1957 | Porter | 160/216 |
| 2,896,277 | 7/1959 | Halligan | 20/71 |
| 2,928,146 | 3/1960 | Kuniholm | 20/71 |
| 3,074,740 | 1/1963 | Zostrew | 280/179 |
| 3,163,205 | 12/1964 | Gottlieb | 160/216 |
| 3,425,165 | 2/1969 | Cleveland | 49/55 |
| 3,572,511 | 3/1971 | Triplett | 211/105.6 |
| 4,118,087 | 10/1978 | Dorf | 211/105.6 |

FOREIGN PATENT DOCUMENTS

| | | | |
|---|---|---|---|
| 1337034 | 7/1963 | France | 211/105.6 |
| 161936 | 1/1958 | Sweden | 211/105.6 |

*Primary Examiner*—Peter M. Caun

*Attorney, Agent, or Firm*—John E. Reilly

[57] ABSTRACT

An infant security door gate is adapted for releasable disposition between opposed sides of a doorway and comprises upper and lower expansible support bars which are telescopingly adjustable to conform to the space between the sides and at the same time are spring-loaded so as to yieldingly engage the sides under spring tension at any adjusted position, and a pair of complementary slidably interfitting panels are arranged for adjustable disposition on separate telescoping portions of the support bars so as to follow the expansion and contraction of the support bars to substantially close the opening between opposite sides. The panels are characterized by being of corresponding construction and having complementary slidably interconnecting portions for ease of adjustment, or expansion and contraction, in following the telescoping movement of the support bars.

6 Claims, 6 Drawing Figures

INFANT SECURITY DOOR GATE ASSEMBLY

This application is a continuation of Ser. No. 283,044, filed July 13, 1981, now abandoned, entitled INFANT SECURITY GATE ASSEMBLY, invented by Albert W. Gebhard and assigned to the assignee of the present invention.

This invention relates to removable closures, and more particularly relates to a novel and improved door gate of the type intended for use as an infant security device.

BACKGROUND AND FIELD OF THE INVENTION

Various means and techniques have been devised for the formation of barriers or closures across area ways, such as stairways or doorways, in order to limit or confine an infant to a particular area of a home so as to prevent accidents. Among the various approaches taken in the past to a solution of this problem has been to form an adjustable gate which has overlapping panels secured between support bars or struts so that the struts when adjusted to fit a particular opening will cause the panels to advance therewith in substantially closing the opening. Typical of this approach is U.S. Pat. Nos. 3,163,205 to Gottlieb, 2,756,469 to Cattermole et al, and 2,701,927 to Dyer.

It has also been proposed in the past in other arts to employ telescoping spring-biased rods to serve as an adjustable support across areas, such as, a doorway in which opposite ends of the rods can be yieldingly urged under spring tension into firm engagement with the opposed end wall surfaces. For example, U.S. Pat. No. 1,662,167 to Rexinger discloses a spring-biased rod which forms a window grating and another window.

In accordance with the present invention, there has been devised a novel and improved infant security gate assembly which forms a releasable closure adapted for disposition between spaced, confronting sides of an area way, such as, a doorway or stairway, the gate assembly comprised of a pair of panels arranged in parallel, substantially overlapping relation to one another, and supporting means for said panel including upper and lower common support bars traversing the upper and lower edges of said panels and to which said panels are secured. Sleeve members are disposed at upper and lower corners of said pair of panels for insertion of said support bars therethrough, at least one of the sleeve members on one panel being connected to one of the support bars, and the sleeve members of the other panel being slidable with respect to the support bars. Each support bar includes telescoping tubular sections having side-engaging means at opposite ends thereof and threaded adjustment means between each of the telescoping tubular sections for rotating one of the tubular sections to vary the effective length of the support bars, the threaded adjustment means having spring-loading means to yieldingly urge the telescoping sections of each support bar in an outward direction forcing the side-engaging ends into engagement with the sides of the area way, and panel expansion means associated with one of the tubular sections engageable with the other of said panels to cause said other panel to follow the movement of the one tubular section in the outward direction.

A further object of the present invention is to provide for a novel and improved infant security gate of the type described which is of unitary construction and comprised of a minimum number of parts having novel and improved telescoping support members to facilitate adjustable disposition and engagement of the gate assembly between doorways or other area ways of different widths while avoiding the use of permanent fasteners.

In accordance with the present invention, there has been devised a novel and improved form of infant security gate assembly which is specifically conformable for use in forming a releasable closure across a doorway or stairway, the gate assembly being broadly comprised of a plurality of panels arranged in parallel, substantially overlapping relation to one another, and supporting means for the panels having upper and lower common support bars to which the panels are secured, each of the support bars including telescoping tubular sections having threaded adjustment means therebetween to vary the effective length of said support bars, there being vertical surface-engaging end portions on the support bars, and the threaded adjustment means having spring-loading means associated therewith to yieldingly urge the telescoping sections in a direction forcing the vertical surface-engaging end portions into engagement with the opposed confronting sides of a doorway.

Preferably, the panels are of corresponding construction and are formed with complementary slide fastener elements therebetween. The panels are of generally rectangular configuration having outer solid frame portions and inner grid portions with support bar sleeves at each corner of the panel to permit insertion of the support bars in the form of the telescoping tubular sections. The sleeves on the outside corners of one panel are positively secured to follow the movement of one of the tubular sections, but the sleeve connectors on the inside corners of the one panel are free to slide relative to the other tubular sections. Further, the sleeves on the other panel are mounted on the other stationary tubular section so that the one panel is free to follow the relative lengthwise movement of the movable sections as they are expanded and contracted relative to the other stationary tubular sections in order to vary the overall effective width of the panels to effectively form a closure which will prevent ingress or egress through the doorway.

The support bars are constructed in a novel and distinct manner to incorporate a spring-loaded coil spring arrangement extending between the telescoping tubular sections and which springs are threadedly adjustable along spring-engaging lugs within the tubular sections by rotation of one of the tubular sections with respect to the other. By adjusting the effective length of the support bars to be just greater than the width of the doorway, inward compression of the tubular section so as to fit between the doorway will cause the spring coil to exert the desired degree of tension against the opposed vertical surface-engaging end portions and permit mounting of the gate in press-fit relation across the doorway.

The above and other objects, advantages and features of the present invention will become more readily appreciated and understood from a consideration of the following detailed description of a preferred embodiment of the present invention when taken together with the accompanying drawings of a preferred embodiment of the present invention, in which:

DETAILED DESCRIPTION OF THE PREFERRED EMBODIMENT

Figure 1:
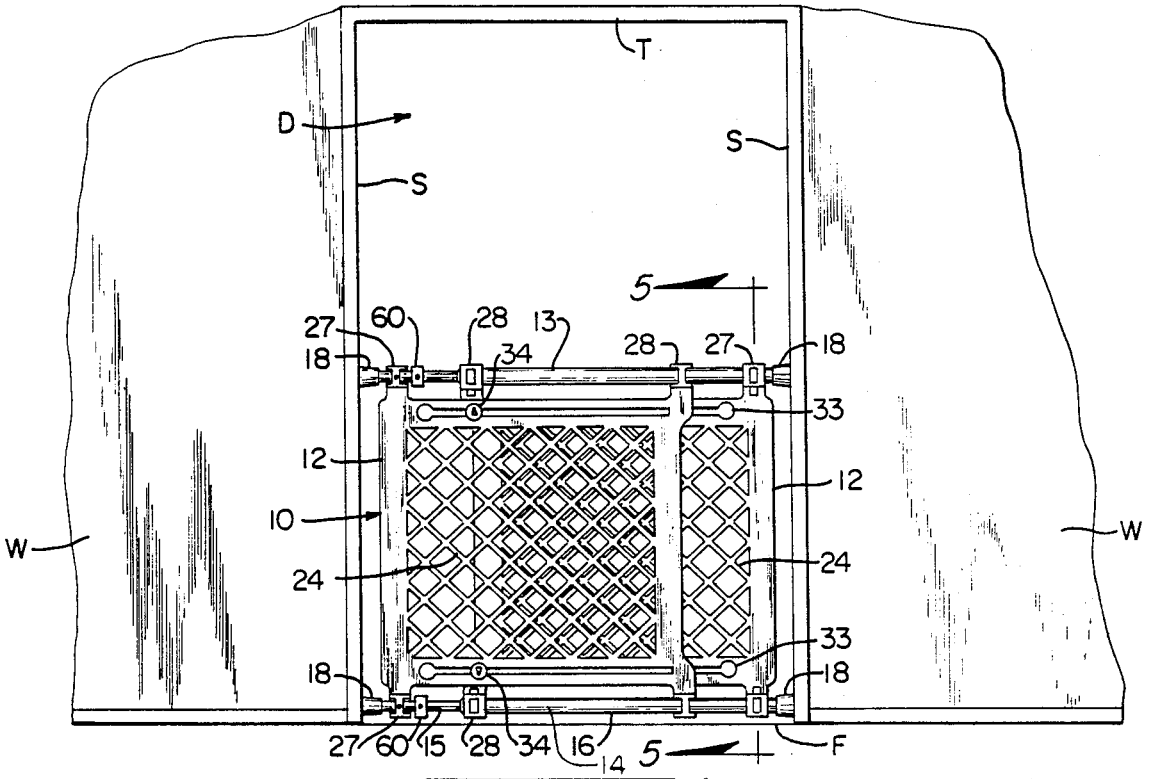
FIG. 1 is a front view in elevation of a door gate assembly installed between opposed confronting vertical surfaces of a doorway.
Figure 2:
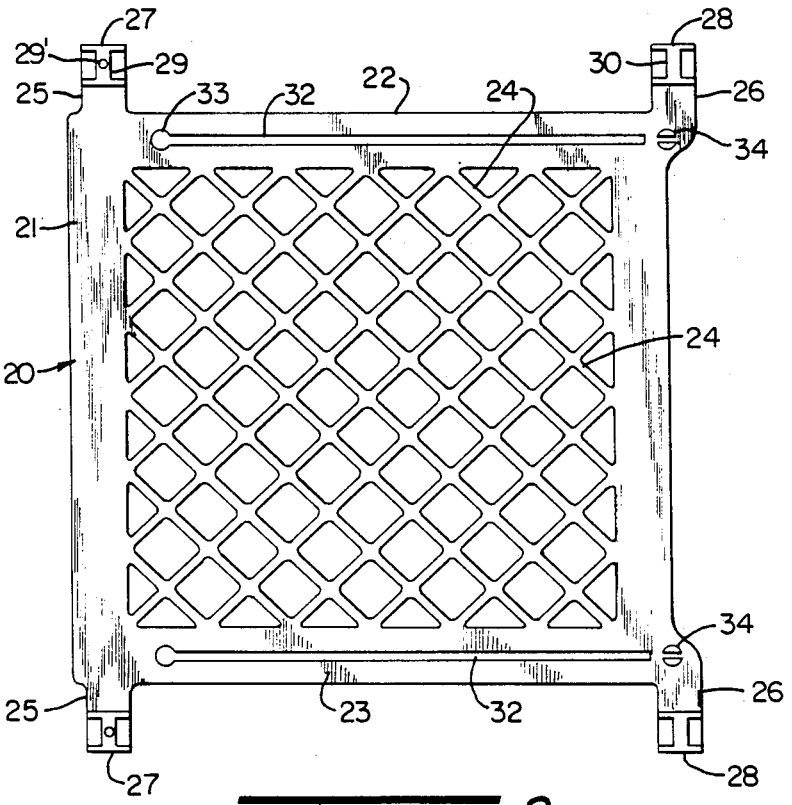
FIG. 2 is a front view in elevation of an individual panel portion in accordance with the present invention.
Figure 3:
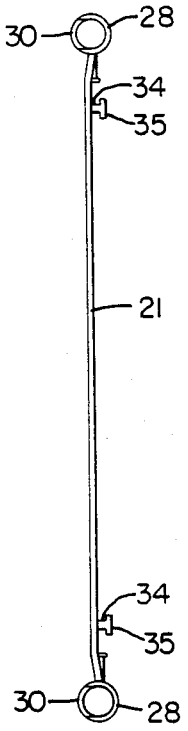
FIG. 3 is a side view of the panel portion shown on FIG. 2.

Referring in detail to the drawings, there is shown by way of illustrative example in FIG. 1, the assembly and installation of a preferred form of door gate assembly 10 across an area way, such as, a doorway as represented at D. The doorway may generally be characterized as having vertical side edges represented at S at the ends of the wall surfaces W and which form door jambs on opposite sides of the doorway together with an upper or top edge T and a lower floor surface represented at F. The preferred form of door gate assembly 10 is comprised of a pair of generally rectangular panels 12 disposed in parallel, partially overlapping relation to one another, the panels 12 being mounted on common upper and lower support bars 13 and 14, respectively. The upper and lower support bars 13 and 14 are correspondingly made up of telescoping inner and outer tubular sections 15 and 16 having end caps 18, each of the upper and lower support bars being threadedly adjustable and spring-loaded in a manner to be described to yieldingly urge the opposite ends of the support bars into pressfit engagement with the opposed confronting vertical edges S of the wall surfaces W. Further, in a manner to be hereinafter described, the panels are so mounted as to be slidably adjustable with variations in length of the support bars 13 and 14 so that the effective overall width of the panels can be varied to form an effective and complete closure across the doorway.

Considering in more detail the construction and arrangement of the panels 12, the panels are of corresponding construction and therefore a description of one will suffice for both of the panels. Each is characterized by having an open, generally rectangular frame 20 consisting of side frames 21 and top and bottom frame portions 22 and 23 formed as one unitary section in a common plane with an open central grid or latticework 24 formed within the frame 20. Opposite corners of the top frame portion 22 have upwardly directed legs 25 and 26, the latter being slightly offset to project somewhat laterally, then upwardly from the corner of the frame, and the legs 25 and 26 terminate in upper sleeves 27 and 28, respectively. Each sleeve 27 and 28 is formed on a horizontal axis and is partially split or divided with an annular or arcuate strap 29 and 30 joining the split edges of each of the respective sleeves 27 and 28. The strap 29 is provided with a limited opening 29' for a purpose to be hereinafter described. In addition, the top frame portion 22 has on one flat surface thereof a horizontally extending slot or keyway 32 which is of narrow elongated configuration and traverses the substantial length of the top frame portion and terminates in an enlarged generally circular entrance end 33 at a point adjacent to or relatively near the leg 25. The slot 32 extends through the thickness of the frame portion. In turn, a male insert or button 34 projects away from the flat surface of the top frame portion adjacent to the narrow end of the slot 32, the button having an enlarged end or head 35 which is sized for insertion into the enlarged entrance end 33 of the slot 32 on an adjacent panel for slidable movement along the narrow elongated section of the slot.

Figure 4:
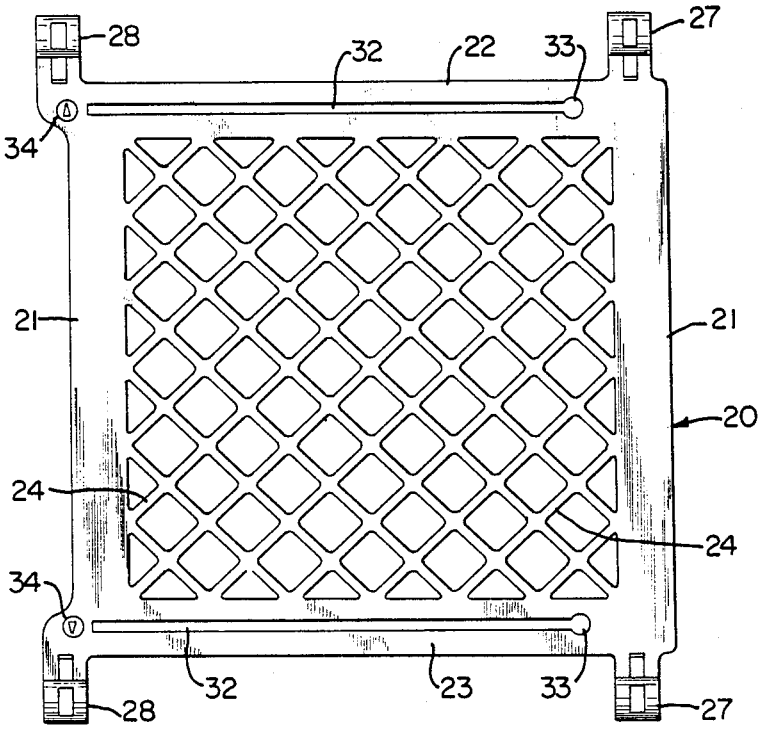
FIG. 4 is a rear view in elevation of the panel portion shown in FIG. 2.

The bottom frame portion 23 contains identical legs 25 and 26, horizontal slotted portion 32 and male insert 34 to that of the top frame portion but oppositely directed away from the bottom frame. Accordingly, like elements or parts are correspondingly enumerated to the top frame portion. In this same relation, FIG. 4 merely illustrates the reversal of one of the panels 12 such that the legs 25 and 26 are reversed from left to right and the slots 32 of an adjacent panel are in confronting relation to those of the first panel. In this way, a complementary slide fastener assembly is formed between the panels in which the male inserts 34 on each panel may be aligned with the entrance ends 33 of the confronting slot portions on the other panel for insertion into the entrance ends and for slidable advancement along the keyways of the respective slots in the relationship shown in FIG. 1.

Figure 5:
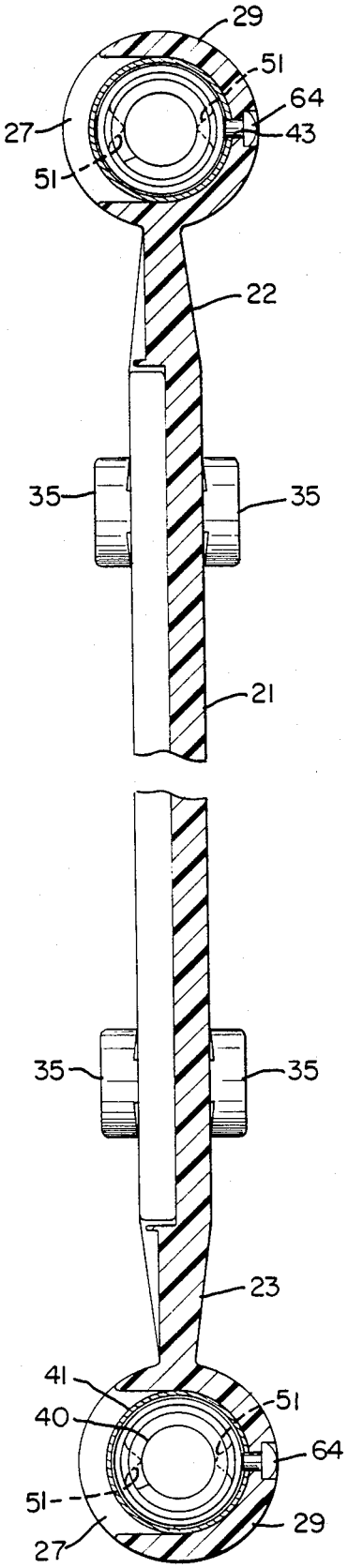
FIG. 5 is a cross-sectional view taken about lines 5—5 of FIG. 1.
Figure 6:
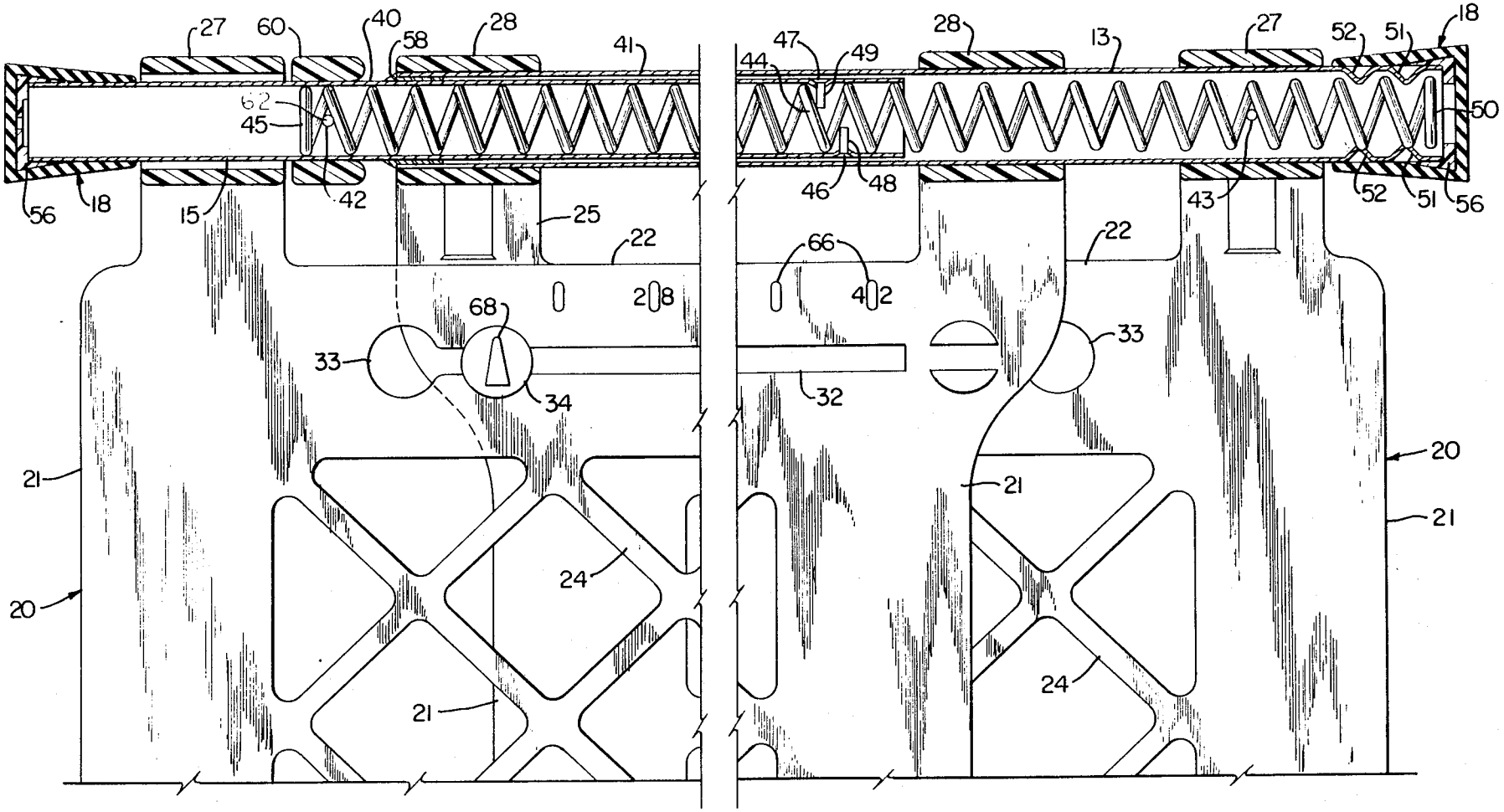
FIG. 6 is an enlarged view in detail and partially in section illustrating the preferred form of construction of one of the support bars for the door gate assembly.

The upper and lower support bars 13 and 14 are of corresponding construction and size so that a description of one is sufficient for both. Referring to FIGS. 5 and 6, each support bar is made up of inner and outer telescoping tubular sections 40 and 41 of substantially identical length, although exact or substantial correspondency in length is not essential to the invention. Each is of uniform diameter, the inner tube being provided with an opening 42 for insertion of a rivet to be hereinafter described, and the outer tube 41 is provided with a limited opening 43 for insertion of a rivet or lug to be hereinafter described. An elongated, coiled spring 44 is sized for insertion and assembly within the inner tube 40 as illustrated such that one end 45 of the spring is located at a point greater than one-half the distance from that end of the tube 40 inserted through the larger tube 41. That same end 40 is provided with diametrically opposed depressions or dimples 46 and 47 which are just slightly offset from one another and are provided with apertures for insertion of rivets 48 and 49, respectively, the rivets 48 and 49 defining spring-engaging lugs for threaded or rotational advancement of the spring with respect to the lugs when the inner tube is rotated with respect to the spring, or vice versa. The end 50 of the coiled spring 44 which projects from the end of the inner tube is freely insertable through the larger tube 41 and is fixed in position within the distal end of the larger tube by diametrically opposed pairs of dimples 51 and 52, there being a pair of dimples 51 on the lower surface as illustrated in FIG. 6 and a pair of dimples 52 on the upper surface. As can be seen, the dimples 51 and 52 are offset slightly from one another such that the innermost points on the dimples 51 will bear against the spring causing the spring to be effectively locked in position within the distal end of the larger tube. In other words, while the spring is threadedly adjustable with respect to the lugs 48 and 49, the end 50 of the spring engageable with the depressions or dimples 51 and 52 is fixed with respect to the larger tube. As a result, threaded adjustment between the tubular sections is effected by advancement of the coil spring through the inner tubular section 40. The end caps 18 are of corresponding construction, each being comprised of a generally cup-shaped rubber tip assembled over a plastic bushing 56 which is affixed over the distal or opposite ends of the inner and outer tubular sections 40 and 41. Of course, the bushing 56 and end caps 18 for the larger tubular section are slightly larger than the end caps for the smaller tubular sections. In addition, to facilitate slidable movement of the inner tubular section 40 with respect to the outer section 41, an annular bushing 58 is inserted into the end of the outer tubular section opposite to the affixed end 50 of the spring and provides a low coefficient of friction inner wall surface to guide the slidable or rotational movement of the external wall surface of the inner tube with respect to the outer tube.

In the installation and use of the preferred form of door gate assembly, a pair of the panels 12 are reversed so that their slotted portions 32 are in confronting relation to one another and adapted to receive the male insert 34 as described. Once assembled in connected slidable relationship to one another, it will be seen that the panels are disposed in spaced parallel, partially overlapping relation to one another as illustrated in FIG. 1. The panels may be substantially increased in effective overall width by sliding one panel away from another in accordance with the width of the closure. In assembled relation, the upper sets of sleeves 27 and 28 on each of the panels are aligned on a common axis, the sleeves 27 and 28 being sized to permit insertion of the larger tubular section 41 so that the larger tubular section 41 may be inserted through the aligned pair of sleeves 28 and the smaller tubular section 40 inserted through the aligned pair of sleeves 27.

Assuming that the upper and lower support bars 13 and 14 are preassembled as described, with the exception of the end cap 18 on the smaller tube section, each support bar may be inserted lengthwise by passing the end of the smaller tubular section 40 through the sleeves 28 and through the first sleeve 27. As a preliminary to insertion through the outside corner sleeve 27, however, a locking sleeve or collar 60 is fixed to each inner tube 40 by insertion of a rivet 62 radially through an opening in the sleeve 60 and into the opening 42 in each inner tube so as to permanently affix the sleeve 60 to the tube relatively near the distal or outer end of the inner tubular section 40. Another rivet 64 is inserted through the opening 29 in the outermost sleeve 27 of the other panel to fix the panel to the outer tube section 41 or, conversely, to fix the outer tube with respect to the other panel while leaving the inner tube 40 free to be rotated along with the sleeve 60 with respect to the one panel and to the outer tube. In this way, threaded adjustment of the tubular sections is effected by rotation of the inner tube 40 with respect to outer tube 41 so as to advance the inner tube along the spring coil 44 to the desired length. In order to adjust the upper and lower support bars 13 and 14 to be of equal length, measuring strikes or marks 66 are provided along the flat surface of the top frame portions directly above the slotted portions 32 as well as beneath the lower slotted portions 32. Again, as seen from a consideration of FIG. 6, movement of the upper and lower legs 25 with respect to the measuring marks 66 will serve as an indication of correspondency in length between the upper and lower sections by comparing the positions of the pointers 68 on the outer surfaces of the button heads 35.

The completed door gate assembly is readily installed in an area way or doorway by threadedly adjusting the upper and lower support bars 13 and 14 until their effective length is just greater than that of the distance between side edges S, for example, as illustrated in FIG. 1. Each support bar in turn may then be compressed until its end caps 18 clear the edges S and can be inserted therebetween at the desired height above the floor surface. Release of the support bars will then cause the end caps to bear firmly against the edges S under the urging of the coiled springs 44 thereby securely lodging the door gate assembly in place. The panel 12 having its corner sleeves 27 mounted on the inner tube 40 will be free to follow the movement of the inner tube and to expand or contract relative to the other panel 12 which is suspended between the upper and lower, fixed outer tubes 41. The locking sleeves 60 are engageable with the sleeves 27 as the inner tubes 40 are expanded so as to cause the associated panel 12 to expand with the tubes 40 and maintain its outer side frame 21 in closely spaced relation to the side edge S of the door. When the tubes 40 are adjusted inwardly to contract the panels 12, the end caps 18 will bear against the sleeves 27 to cause the panel 12 to follow the contraction of the tubes 40 with respect to the outer tubes 41.

It will be appreciated from the foregoing that the door gate assembly as described may be mounted for extension of the support bars either in a horizontal or vertical direction. In the latter case, the support bars may for example extend between a floor surface and upper door jamb or between a floor and ceiling and require the assembly of multiple pairs or sets of panels on extremely long tubular sections. Nevertheless, its principal application and use is for infant security and in preventing ingress and egress to and from a room area. The simplicity of the assembly is such that a single panel construction is required and single support bar construction as described with complete correspondency between the two which will facilitate their interchangeable use either as upper or lower supports. The amount or degree of tension or pressure fit can be easily regulated by the compression of the springs in threadedly adjusting the support bars preliminary to compression of the springs between the opposed edges of the area way to be closed or obstructed. Preferably, the panels are molded of a polyvinyl chloride or other flexible plastic material which, when assembled together, with lend the desired rigidity or strength to the entire assembly.

It is therefore to be understood that various other modifications and changes may be made in the present invention without departing from the spirit and scope thereof as defined by the appended claims.

I claim:

1. A releasable closure adaptable for disposition between spaced, confronting sides of an area way comprising:

a pair of panels arranged in parallel, substantially overlapping relation to one another, and supporting means for said panels including upper and lower common support bars traversing the upper and lower edges of said panels and to which said panels are secured, sleeve members disposed at upper and lower corners of said pair of panels for insertion of said support bars therethrough, at least one of said sleeve members on one panel being positively connected to one of said support bars, said support bar being fixed against rotation within said one sleeve, and said sleeve members on the other of said panels being slidable with respect to said support bars, said support bars being journaled for rotation therein, each of said support bars including telescoping tubular sections having side-engaging means at opposite ends thereof, and threaded adjustment means between each of said telescoping tubular sections for rotating one of said tubular sections to vary the effective length of said support bars, said threaded adjustment means having spring-loading means associated therewith to yieldingly urge said telescoping sections of each support bar in an outward direction forcing said side-engaging ends into engagement with the sides of said area way, and panel expansion means associated with said one of said tubular sections comprising locking collar means engageable with said one of said sleeve members on said other of said panels to cause said panel to resist sliding movement in an inward direction and to follow the movement of said one tubular section in said outward direction.

2. A releasable closure according to claim 1, including means on each each panel for releasably and slidably interconnecting said panels in predetermined spaced relation to one another for relative sliding movement between said panels in following the movement of said support bars, including a horizontally extending slotted portion with an enlarged entrance portion in one of said panels and a cooperating male insert portion in the other of said panels inserted into said entrance portion for slidable movement within said one of said panels.

3. A releasable closure according to claim 2, said threaded adjustment means defined by a coil spring extending between said tubular sections, pairs of radially inwardly directed spring-engaging projections secured in one of said tubular sections, said projections of each pair being offset from one another, and opposed, offset spring-engaging lugs in the other of said tubular sections engageable with successive coils of said spring whereby turning of said other tubular section will cause threadedly adjustable movement of said one tubular section with respect to the other of said tubular sections.

4. In a releasable closure adaptable for disposition between spaced, confronting vertical wall surfaces in which a plurality of panels are arranged in parallel, substantially overlapping relation to one another, the improvement comprising: supporting means for said panels including upper and lower common support bars traversing the upper and lower edges of said panels and between which said panels are suspended, each of said support bars including telescoping tubular sections and rotatable adjustment means between each of said telescoping tubular sections whereby rotation of one of said tubular sections is operative to vary the effective length of each of said support bars, one of said panels being fixed with respect to said tubular sections and said one tubular section being rotatable with respect to the other of said panels and said other of said panels being slidable with respect to said tubular sections, and panel expansion means in the form of a stop member associated with said one of said tubular sections and engageable with said other of said panels to cause said other of said panels to follow the movement of said one tubular section in a direction forcing said vertical surface-engaging ends into engagement with the said vertical wall surfaces and to arrest sliding movement of said other of said panels in a direction away from said wall surfaces.

5. An infant security gate adaptable for disposition between opposite sides of a doorway, comprising:

a pair of closure panels arranged in parallel, substantially overlapping relation to one another, each of said panels being of rectangular configuration having an outer solid frame portion and inner grid portion;

supporting means for said panels including sleeve members disposed at upper and lower corners of said panels, a pair of upper and lower common support bars between which said panels are suspended, each of said support bars including telescoping tubular sections, one of said panels being fixed to one of said support bars and the other of said panels being slidable with respect to said support bars, said supporting means further having threaded adjustment means between said telescoping tubular sections of each said support bar whereby rotation of one of said tubular sections with respect to the other of said tubular sections of each supporting means and of said sleeve members of said other of said panels is operative to vary the effective length of said support bars and the effective overall width of said panels, said threaded adjustment means having spring-loading means to yieldingly urge said telescoping sections in a direction increasing their overall length, panel expansion means defined by at least one locking sleeve positioned on said one of said tubular sections engageable with one of said sleeve members on the other of said panels to arrest sliding movement of said other of said panels and to cause the other of said panels to follow movement of said tubular section in an outward direction toward a side of the doorway, and side-engaging end surfaces on each of said support bars movable into frictional engagement with opposed confronting vertical surfaces under the urging of said threaded adjustment means; and slide fastener means slidably interconnecting said panels for relative sliding movement between said panels in varying the effective overall width of said panels, said slide fastener means including on one of said panels horizontally directed slotted portions provided with enlarged entrance portions, and cooperative male insert means on the other of said panels insertable into said entrance portions for slidable movement through said slotted portions in following the inward and outward telescoping movement between said upper and lower telescoping sections.

6. In a releasable closure according to claim 5, said spring-loading means means defined by a coil spring extending between said tubular sections, and spring-engaging lugs in each section engageable with said coil spring whereby turning of said spring will cause threadedly adjustable movement of one tubular section with respect to the other along said spring-engaging lugs.

* * * * *

UNITED STATES PATENT AND TRADEMARK OFFICE

CERTIFICATE OF CORRECTION

PATENT NO. : 4,492,263

DATED : January 8, 1985

INVENTOR(S) : Albert W. Gebhard

It is certified that error appears in the above—identified patent and that said Letters Patent is hereby corrected as shown below:

Column 1, line 26, cancel "is" and substitute -- are --.

Column 1, line 36, cancel "window." and substitute -- window securement device is illustrated in U.S. Letters Patent No. Re.19,617 to Van Dresser. It is proposed, however, to provide an adjustable door gate assembly of the type described which affords much greater latitude in adjustment, increased stability while avoiding the use of direct or positive fastening of the assembly to the structure or area way in which it is used, and further which is completely safe both to install and use.

Summary of the Invention

It is therefore an object of the present invention to provide for a novel and improved gate assembly which is conformable for adjustable but secure disposition across an area way.

UNITED STATES PATENT AND TRADEMARK OFFICE

CERTIFICATE OF CORRECTION

PATENT NO. : 4,492,263

DATED : January 8, 1985

INVENTOR(S) : Albert W. Gebhard

It is certified that error appears in the above—identified patent and that said Letters Patent is hereby corrected as shown below:

Another object of the present invention is to provide for a novel and improved infant security gate assembly which affords substantially increased adjustability for disposition across a doorway or other openings of different widths, is of simplified construction and can be rapidly and easily installed or removed as required.

A further object of the present invention is to provide for a novel and improved infant security gate of the type described which is of unitary construction and comprised of a minimum number of parts having novel and improved telescoping support members to facilitate adjustable disposition and engagement of the gate assembly between doorways or other area ways of different widths while avoiding the use of permanent fasteners. --

Column 1, cancel lines 67 and 68.

Column 2, cancel lines 1 through 26.

Column 5, line 49, cancel "29" and substitute -- 29' --.

UNITED STATES PATENT AND TRADEMARK OFFICE

CERTIFICATE OF CORRECTION

PATENT NO. : 4,492,263

DATED : January 8, 1985

INVENTOR(S) : Albert W. Gebhard

It is certified that error appears in the above—identified patent and that said Letters Patent is hereby corrected as shown below:

Column 6, line 47, cancel "with" and substitute -- will --.

In the Claims:

Column 7, line 23 (claim 2), cancel "each" (2nd occurrence).

Column 8, line 57 (claim 6), cancel "means" (2nd occurrence).

Signed and Sealed this

*Sixteenth* Day of *July 1985*

[SEAL]

*Attest:*

DONALD J. QUIGG

*Attesting Officer* *Acting Commissioner of Patents and Trademarks*